US005740612A

United States Patent [19]

Takeshita et al.

[11] Patent Number: 5,740,612

[45] Date of Patent: Apr. 21, 1998

[54] PLASTIC BOTTLE CUTTING IMPLEMENT

[75] Inventors: Sotoshi Takeshita; Toshimichi Kotani, both of Takaoka, Japan

[73] Assignee: Koeitsusho Kabushiki Kaisha, Toyama, Japan

[21] Appl. No.: 723,090

[22] Filed: Sep. 30, 1996

[30] Foreign Application Priority Data

Oct. 7, 1995 [JP] Japan ..... 7-296348

[51] Int. Cl.[6] ..... B26B 29/06

[52] U.S. Cl. ..... 30/115; 30/1.5; 30/90.1; 30/289; 30/293; 30/310

[58] Field of Search ..... 30/115, 1.5, 90.1, 30/90.7, 282, 283, 289, 293, 300, 310

[56] References Cited

U.S. PATENT DOCUMENTS

| | | | |
|---|---|---|---|
| 3,398,610 | 8/1968 | Matthews | 30/90.1 |
| 3,533,313 | 10/1970 | Matthews | 30/90.1 |
| 3,940,842 | 3/1976 | Perrinelle et al. . | |
| 4,333,234 | 6/1982 | Smith et al. . | |
| 4,503,612 | 3/1985 | Davis | 30/293 X |
| 4,532,837 | 8/1985 | Cushenbery et al. | 30/293 X |
| 4,845,849 | 7/1989 | Aubriot . | |
| 4,972,587 | 11/1990 | Horntrich . | |

FOREIGN PATENT DOCUMENTS

| | | | |
|---|---|---|---|
| 0220850 A2 | 5/1987 | European Pat. Off. . | |
| 0279737 A2 | 8/1988 | European Pat. Off. . | |
| 735641 | 4/1943 | Germany | 30/90.1 |
| 3812336 C1 | 8/1989 | Germany . | |
| 3006155 | 10/1994 | Japan . | |
| 1240288 | 7/1971 | United Kingdom | 30/289 |

*Primary Examiner*—Douglas D. Watts

*Attorney, Agent, or Firm*—Frishauf, Holtz, Goodman, Langer & Chick

[57] ABSTRACT

A plastic bottle cutting implement for reducing a plastic bottle such as a PET bottle to an easily compactible form for disposal comprises a cylindrical or part-cylindrical covering member and a blade disposed projecting from the inside surface of this covering member, and the direction in which the blade projects has any angle other than perpendicular and parallel with respect to the imaginary center axis of the cylindrical covering member. A grip part is attached to the outer side of the covering member. The grip part is bar-shaped and is attached projecting from the outer side of the covering member, a hollow part connecting with the inside of the covering member is formed inside the grip part and a sliding fitting slidable inside the hollow part and fixable in any position inside the hollow part and a blade having one end thereof attached to the sliding fitting are disposed inside this hollow part. The cutting direction of the blade intersects diagonally with a plane orthogonal to the imaginary center axis of the covering member.

6 Claims, 5 Drawing Sheets

PLASTIC BOTTLE CUTTING IMPLEMENT

BACKGROUND OF THE INVENTION

1. Field of the Invention

This invention relates to a plastic bottle cutting implement for cutting a blow-molded plastic bottle.

2. DESCRIPTION OF THE RELATED ART

Known implements for cutting plastic bottles such as PET bottles include that disclosed by the present inventors in Japanese Utility Model Publication No. 3006155. This cutting implement has a cylindrical covering member which fits with slight looseness around the outside of a plastic bottle, and a bar-shaped grip part is attached to the outer side of this covering member and projects outward. A blade for cutting is provided on the inner side of the covering member projecting in a direction perpendicular to the center axis of the covering member.

This plastic bottle cutting implement is used by first inserting a plastic bottle to inside the covering member and pressing the blade through the side wall of the plastic bottle. Then, while the grip part is held, the plastic bottle is rotated about its center axis so that it is pushed onto the blade and the plastic bottle is thereby cut. The line along which the plastic bottle is cut by the plastic bottle cutting implement makes a circumference of the side wall of the plastic bottle and the plastic bottle is thereby cut into two pieces. When this is repeated several times, the plastic bottle is cut into several ring-shaped side wall pieces and a top piece and a bottom piece, its volume decreases and space can therefore be saved when it is disposed of.

In the case of this conventional technology, as shown in FIG. 14 and FIG. 15, the blade 3 is inserted in a direction perpendicular to the side wall 21 of the plastic bottle 20, i.e. in the inside-outside direction of the side wall 21, to cut the plastic bottle 20. At this time, both sides of the blade 3 are gripped by the side wall 21 and a very large frictional force acts on it, and a strong force has been required for the cutting. Also, because the frictional resistance is large, there has been the problem that wear of the blade edge 3*a* is severe and it is necessary to replace the blade 3 frequently.

SUMMARY OF THE INVENTION

This invention was made in view of the problem points of the related art technology described above, and an object of the invention is to provide a plastic bottle cutting implement with which it is possible to reliably cut a plastic bottle efficiently.

The invention provides a plastic bottle cutting implement comprising a cylindrical or part-cylindrical covering member and a blade disposed projecting from the inside surface of this covering member, wherein the direction in which the blade projects makes any angle other than perpendicular or parallel with respect to the imaginary center axis of the cylindrical part of the covering member. A grip member is attached to the outer side of the covering member.

The grip member is bar-shaped and mounted projecting from the outer side of the covering member, and a hollow part connecting with the inside surface of the covering member is formed inside the grip member and inside this hollow part are disposed a sliding fitting slidable inside the hollow part and fixable in any position inside the hollow part and a blade having one end thereof attached to the sliding fitting. The grip member is formed foldably with respect to the covering member and can be folded to inside the covering member.

The direction in which the blade cuts intersects diagonally with a plane orthogonal to the imaginary center axis of the covering member. Also, the edge of the blade is formed in an arcuate concave shape in the cross-blade direction.

Also, a plastic bottle cutting implement provided by the invention cuts the side wall of a plastic bottle with the blade inclined with respect to the inside-outside direction of the side wall of the bottle. At this time, because the edge of the blade cuts diagonally with respect to the thickness direction of the side wall of the bottle, although the cut surfaces of the plastic bottle abut with the sides of the blade, because the cut side wall behind the blade escapes to the inner side of the blade, the sides of the blade are not strongly gripped by the cut side walls of the plastic bottle.

DETAILED DESCRIPTION OF THE PREFERRED EMBODIMENTS

Figure 1:
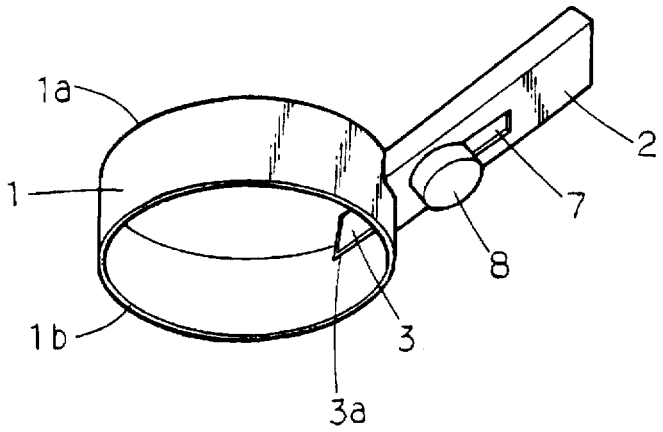
FIG. 1 is a perspective view of a plastic bottle cutting implement of a first preferred embodiment of the invention.
Figure 2:
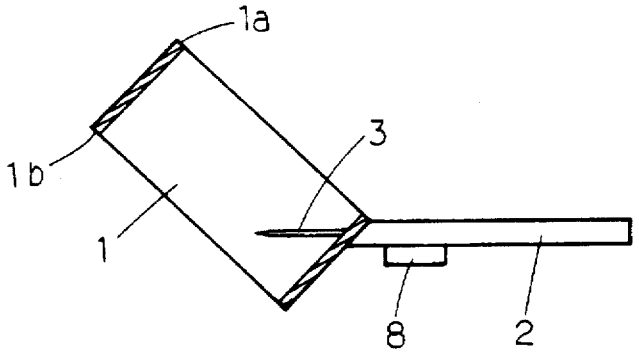
FIG. 2 is a plan view of the plastic bottle cutting implement of the first preferred embodiment with a part cut away.

Preferred embodiments of the invention will now be described with reference to the accompanying drawings. FIG. 1 through FIG. 4 show a first preferred embodiment of a plastic bottle cutting implement of the invention, wherein a covering member 1 is made of a plastic such as ABS resin and is formed in the shape of a cylinder fitting with slight looseness around the side wall of a plastic bottle such as a PET bottle. The upper end face 1*a* and the lower end face 1*b* of this cylinder are each perpendicular with respect to the center axis of the cylinder of the covering member 1.

A plastic, bar-shaped grip part 2 is provided on the outer side of the covering member 1 adjacent to the upper end face 1*a*. The grip part 2 is attached to the side of the covering member 1 at an incline with respect thereto so as to intersect diagonally with the imaginary center axis of the cylindrical covering member 1 and so that the outer end of the grip part 2 is positioned above the upper end face 1*a* of the covering member 1 in the drawings. The grip part 2 is hollow and a narrow and long through hole 7 is provided in the center of the face of the grip part 2 facing downward in the drawings and extending in the length direction of the grip part 2, and a screw member 8 is fitted in the through hole 7.

An opening, not shown in the drawings, connecting with the hollow part of the grip part 2 is provided in the covering member 1, and a narrow and long blade 3 of thin plate shape is inserted into the hollow part of the grip part 2 through this opening. The length direction of this blade 3 is parallel with the grip part 2, and a blade edge 3*a* having an acutely angled tip is formed on one of the sides of the blade 3 parallel with the length direction. Also, a small through hole not shown in the drawings is provided in the blade 3 in the vicinity of the front end of the grip part 2, and the screw of the screw member 8 is fitted into this through hole. Next, the method by which the plastic bottle cutting implement of this preferred embodiment is used will be explained. First, the blade 3 is protruded inside the covering member 1 to a suitable length and the screw member 8 is tightened to fix the blade 3 to the grip part 2. At this time, when the screw member 8 is loosened the blade 3 becomes slidable in parallel with the grip part 2 and when the screw member 8 is tightened the blade 3 is fixed to the grip part 2. Then, a plastic bottle 20 is inserted to inside the covering member 1 and the blade 3 is pressed through the side wall 21 of the plastic bottle 20. While the grip part 2 is held, the plastic bottle 20 is then turned in the direction such that the edge 3*a* cuts into it. When the cutting direction of the blade 3 at this time is set so that it intersects with a plane perpendicular to the center axis of the covering member 1, the plastic bottle 20 is cut in the form of a spiral.

Figure 3:
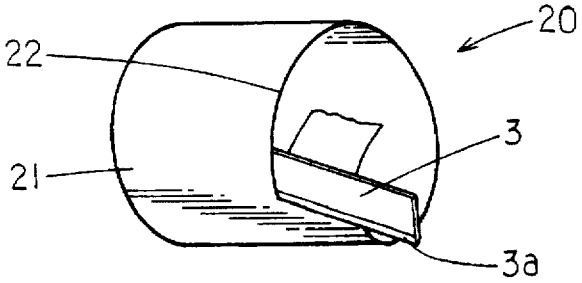
FIG. 3 is a perspective view showing the state of the blade of the plastic bottle cutting implement of the first preferred embodiment during use.
Figure 4:
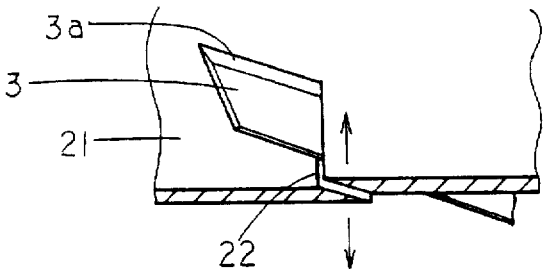
FIG. 4 is an enlarged perspective view showing the state of the blade of the plastic bottle cutting implement of the first preferred embodiment during use.

With the plastic bottle cutting implement of this preferred embodiment, as shown in FIG. 3 and FIG. 4, the blade 3 is inclined with respect to the inside-outside direction of the side wall 21 as it cuts the side wall 21 of the plastic bottle 20. The cut side wall 21 easily opens out along the sides of the blade 3 without applying a pressure to the blade 3. As a result, no strong frictional forces arise between the blade 3 and the side wall 21, a strong force is not necessary for cutting, and it is possible to cut the plastic bottle efficiently while rotating it relatively easily. Also, because the edge 3*a* abuts with the side wall 21 diagonally as it cuts, forces do not concentrate on a part of the edge 3*a* and there is relatively little wear of the edge 3*a*.

Figure 5:
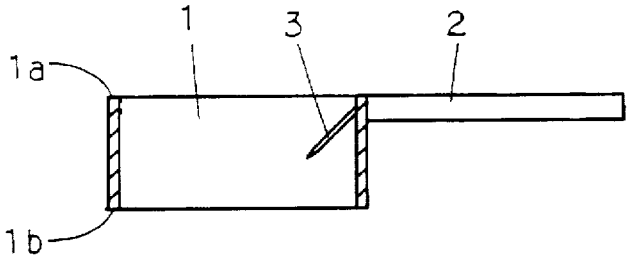
FIG. 5 is a plan view of a plastic bottle cutting implement of a second preferred embodiment of the invention with a part cut away.

Next, a second preferred embodiment of the invention will be described with reference to FIG. 5. Here, parts the same as parts in the preferred embodiment described above have been given the same reference numerals and a description thereof will be omitted. A covering member 1 is cylindrical, and the upper end face 1*a* and the lower end face 1*b* thereof are formed substantially perpendicular with respect to the center axis of the covering member 1. A grip part 2 is attached to the outer side of the covering member 1 on an extension line of the upper end face 1*a* and in parallel with the upper end face 1*a*. Inside the covering member 1, a blade 3 is disposed projecting diagonally with respect to the center axis of the covering member 1, and an edge 3*a* of the blade 3 is provided in parallel with this projection direction.

The plastic bottle cutting implement of this preferred embodiment is used in the same way as that of the first preferred embodiment and has a similar effect, but because the grip part 2 is parallel with the upper end face 1*a* of the covering member 1 it is easier to use.

Figure 6:
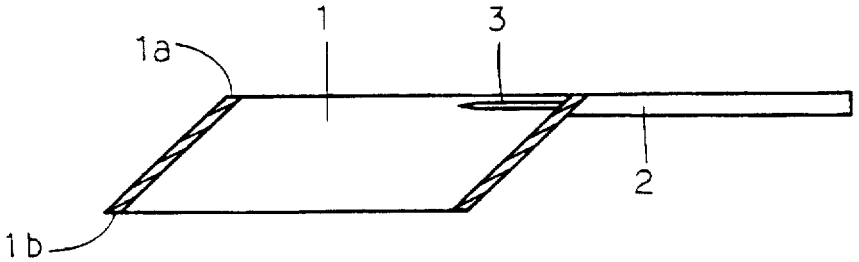
FIG. 6 is a plan view of a plastic bottle cutting implement of a third preferred embodiment of the invention with a part cut away.

Next, a third preferred embodiment of the invention will be described with reference to FIG. 6. Here, parts the same as parts in the preferred embodiments described above have been given the same reference numerals and a description thereof will be omitted. The upper end face 1*a* and the lower end face 1*b* of a covering member 1 are formed parallel with each other and inclined with respect to the center axis of the covering member 1. A grip part 2 is attached to the outer side of the covering member 1 on an extension line of the upper end face 1*a* and in parallel with the upper end face 1*a*. Inside the covering member 1, a blade 3 is disposed parallel with the grip part 2, i.e. projecting diagonally with respect to the center axis of the covering member 1. The plastic bottle cutting implement of this preferred embodiment is used in the same way as that of the first preferred embodiment described above and has a similar effect.

Figure 7:
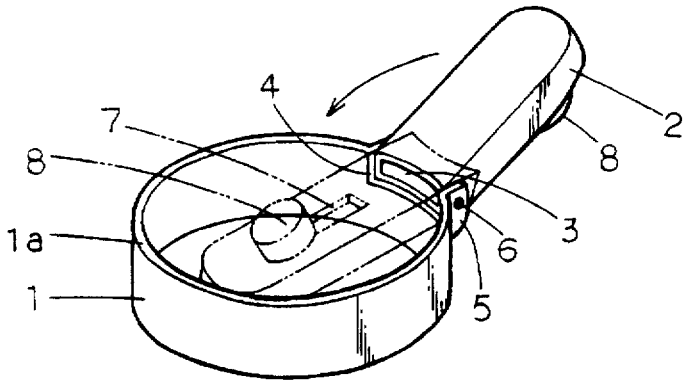
FIG. 7 is a perspective view of a plastic bottle cutting implement of a fourth preferred embodiment of the invention.
Figure 8:
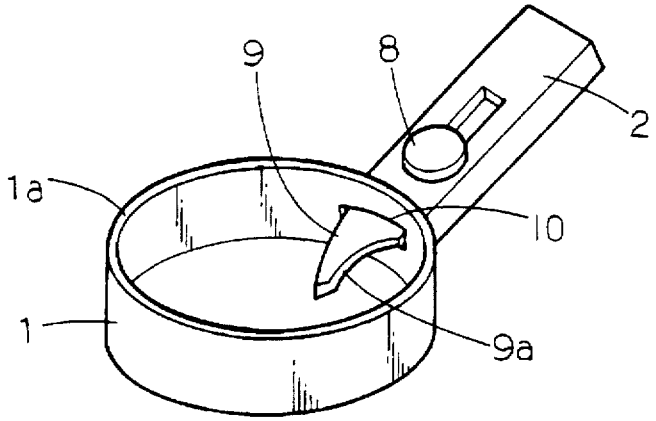
FIG. 8 is a perspective view of a plastic bottle cutting implement of a fifth preferred embodiment of the invention.
Figure 9:
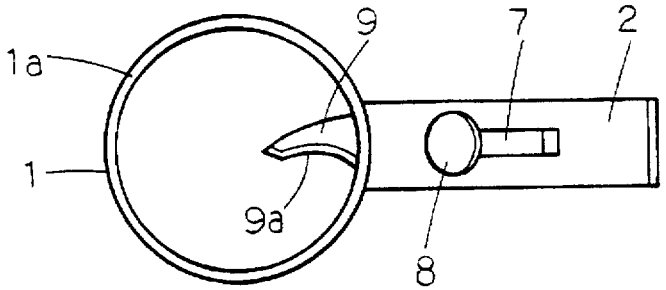
FIG. 9 is a front view of the plastic bottle cutting implement of the fifth preferred embodiment.

Next, a fourth preferred embodiment of the invention will be described with reference to FIG. 7. Here, parts the same as parts in the preferred embodiments described above have been given the same reference numerals and a description thereof will be omitted. The upper end face 1*a* and the lower end face 1*b* of a covering member 1 are formed substantially perpendicular to the center axis of the covering member 1. A grip part 2 is attached to the side wall of the covering member 1 at an incline with respect thereto so as to intersect diagonally with the imaginary center axis of the cylindrical covering member 1 and so that the outer end of the grip part 2 is positioned above the upper end face 1*a* of the covering member 1 in the drawing. A rectangular cutaway 4 is provided in a part of the side wall of the covering member 1 adjacent to the upper end face 1*a*. Plate-shaped receiving parts 5, 5 are formed projecting in parallel with each other from the outer side of the covering member 1, one at each side of the cutaway 4. A bar-shaped grip part 2 of a size such that it has slight looseness with respect to the receiving parts 5, 5 is fitted between the receiving parts 5, 5, and side walls of the grip part 2 are pivotally attached to the receiving parts 5, 5 by pins 6.

The grip part 2 is hollow and a narrow and long through hole 7 is provided in the center of the face of the grip part 2 facing downward in the drawings and extending in the length direction of the grip part 2, and a screw member 8 is fitted in the through hole 7. A blade 3 is inserted in the hollow part of the grip part 2, a through hole is provided in the blade 3 near the end of the grip part 2 and the end of the screw member 8 is fitted into this through hole.

The plastic bottle cutting implement of this preferred embodiment is used in the same way as those of the preferred embodiments described above and has the same effect. Also, when the plastic bottle cutting implement is not being used, it is possible to completely retract the blade 3 into the grip part 2 and fold the grip part 2 to inside the covering member 1 about the pins 6. As a result, the plastic bottle cutting implement takes up little storage space and is easy to carry around.

Figure 10:
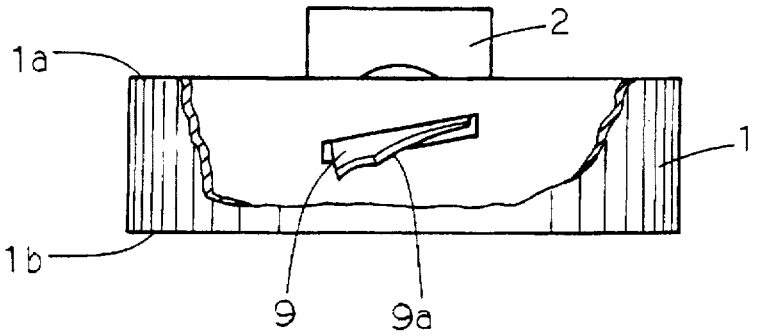
FIG. 10 is a plan view of the plastic bottle cutting implement of the fifth preferred embodiment with a part cut away.

Next, a fifth preferred embodiment of the invention will be described with reference to FIG. 8 through FIG. 11. Here, parts the same as parts in the preferred embodiments described above have been given the same reference numerals and a description thereof will be omitted. A blade 9 of the plastic bottle cutting implement of this preferred embodiment is formed in an arcuate concave shape in the cross-blade direction. Also, as shown in FIG. 10, the blade 9 is disposed slightly inclined with respect to the upper end face 1*a* and the lower end face 1*b* of the covering member 1, and the direction of the side surfaces of the blade 9 leading to the blade edge 9*a*, i.e. the direction in which it cuts the plastic bottle, intersects with a plane perpendicular to the center axis of the covering member 1. Furthermore, the direction of projection of the blade 9 intersects with the center axis of the covering member 1 diagonally at an angle other than 90°. Also, the blade edge 9*a* of the blade 9 is formed in a concave shape in the cross-blade direction. The upper end face 1*a* and the lower end face 1*b* of this covering member 1 are perpendicular to the center axis of the covering member 1.

Figure 11:
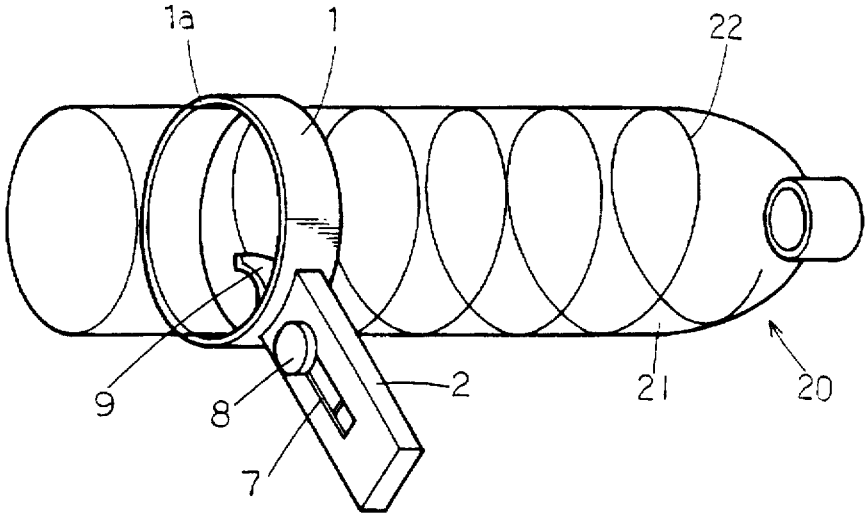
FIG. 11 is a perspective view showing how the plastic bottle cutting implement of the fifth preferred embodiment is used.

The plastic bottle cutting implement of this preferred embodiment is used in the same way as that of the preferred embodiments described above, and has the same effect. Also, because the cut line 22 made by this plastic bottle cutting implement is diagonal with respect to the center axis of the plastic bottle 20, as shown in FIG. 11, the side wall 21 of the plastic bottle is cut in a spiral and is reduced to a band. As a result, the implement is extremely easy to use, and the band-shaped cut plastic bottle side wall 21 can be made compact by being wound into a roll. Also, because the blade edge 9*a* of the blade 9 is formed in an arcuate concave shape, cutting is easy.

Figure 12:
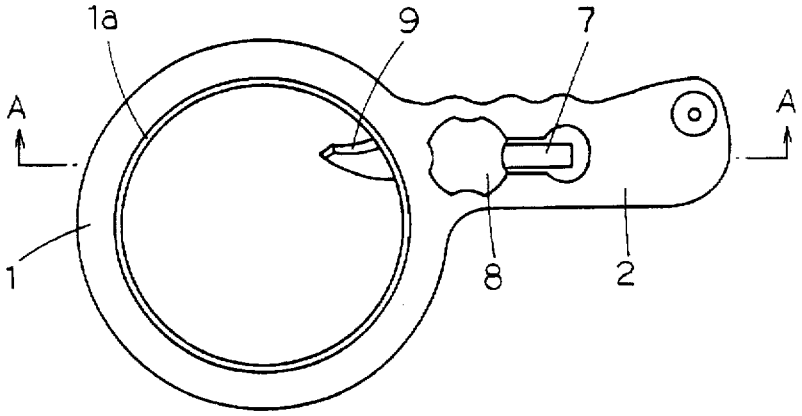
FIG. 12 is a front view of a plastic bottle cutting implement of a sixth preferred embodiment of the invention.
Figure 13:
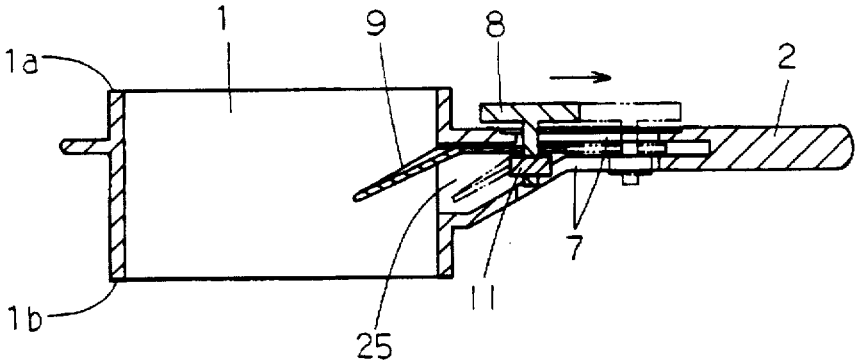
FIG. 13 is a sectional view on the line A—A in FIG. 12.
Figure 14:
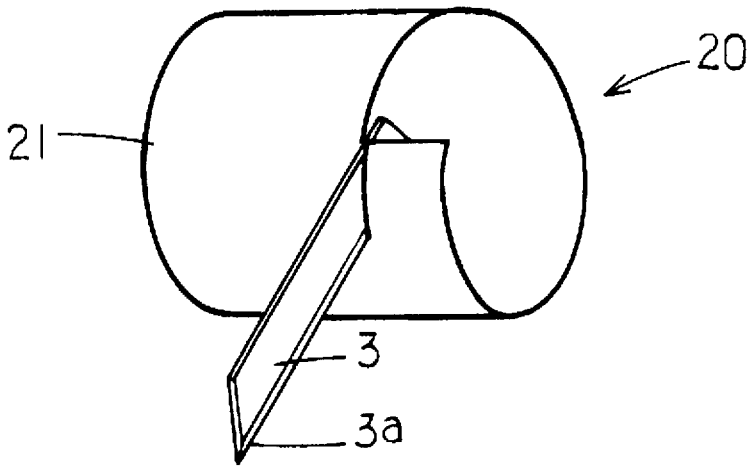
FIG. 14 is a perspective view showing the state of the blade of a conventional plastic bottle cutting implement during use.
Figure 15:
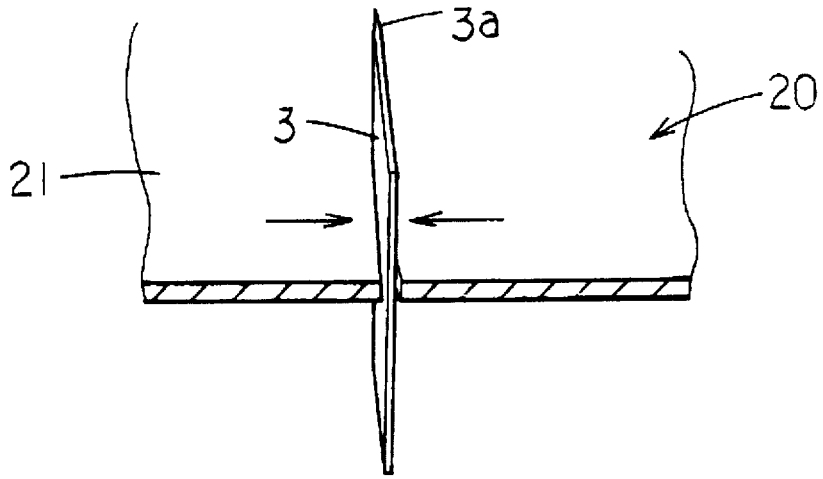
FIG. 15 is an enlarged perspective view showing the state of the blade of a conventional plastic bottle cutting implement during use.

Next, a sixth preferred embodiment of the invention will be described with reference to FIG. 12 and FIG. 13. Here, parts the same as parts in the preferred embodiments described above have been given the same reference numerals and a description thereof will be omitted. A grip part 2 is attached to the outer side of the covering member 1 in parallel with the upper end face 1*a*. The grip part 2 is hollow and narrow and long through holes 7 are provided in the centers of the upper and lower faces of the grip part 2 and extending in the length direction of the grip part 2. A blade 9 is inserted into the hollow part of the grip part 2, a through hole is provided in the blade 9 in the vicinity of the front end of the grip part 2 and the end of a screw member 8 is fitted through this through hole. A square nut 11 is screwed onto the end of the screw member 8. The blade 9 is formed in an arcuate concave shape in the cross-blade direction, and is bent downward in the vicinity where it abuts with the inner side of the covering member 1. A space 25 for receiving the blade 9 is formed in the base end of the grip part 2 and connecting with the inner side of the covering member 1.

The plastic bottle cutting implement of this preferred embodiment also has the same effect as those of the preferred embodiments described above. When the screw member 8 is tightened the blade 9 becomes slidable in parallel with the grip part 2 and can be received in the space 25 in the base end part of the grip part 2.

The plastic bottle cutting implement of this invention is not limited to the preferred embodiments described above, and the shapes and materials of the various parts can be suitably changed, and for example indentations may be provided in the grip part 2 where fingers grip it to make it easier to hold. The means for fixing the blade or cutter also may be suitably changed. The position and angle at which the blade is attached may also be set according to convenience.

This invention, with a simple construction, makes it possible to cut a plastic bottle easily and efficiently, and makes it possible to reduce a used plastic bottle to a compact form for disposal. Furthermore, there is little wearing of the blade and the life of the blade is long.

What is claimed is:

1. A plastic bottle cutting implement comprising:

a cylindrical covering member;

a blade projecting from an inside surface of the cylindrical covering member, the blade projecting in a direct intersecting at any angle other than perpendicular and parallel to an imaginary center axis of the cylindrical covering member; and a hand holdable grip member attached to an outer side of the cylindrical covering member, wherein the blade which projects from said inside surface of the cylindrical covering member is retractably received into the grip member;

and wherein:

the grip member is substantially bar-shaped and is mounted projecting from the outer side of the cylindrical covering member;

the grip member has a hollow part inside the grip member and connecting with the inside surface of the covering member;

a sliding fitting is arranged inside the hollow part so as to be slidable inside the hollow part and so as to be fixable in any position inside the hollow part; and the blade has one end thereof attached to the sliding fitting.

2. The plastic bottle cutting implement of claim 1, wherein the blade is disposed such that a cutting direction of the blade substantially parallel with side surfaces of the blade intersects diagonally with a plane orthogonal to the imaginary center axis of the cylindrical covering member.

3. The plastic bottle cutting implement of claim 1, wherein said sliding fitting includes a fixing member for fixing a position of said sliding fitting relative to the grip member.

4. A plastic bottle cutting implement comprising:

a cylindrical covering member;

a blade projecting from an inside surface of the cylindrical covering member, the blade projecting in a direction intersecting at any angle other than perpendicular and parallel to an imaginary center axis of the cylindrical covering member; and a hand holdable grip member attached to an outer side of the cylindrical covering member, wherein the blade which projects from said inside surface is retractably received into the grip member;

and wherein:

the grip member is pivotally coupled to the covering member; and the grip member is foldable via the pivotal coupling to the inside of the cylindrical covering member.

5. The plastic bottle cutting implement of claim 4, wherein the blade is disposed such that a cutting direction of the blade substantially parallel with side surfaces of the blade intersects diagonally with a plane orthogonal to the imaginary center axis of the cylindrical covering member.

6. The plastic bottle cutting implement of claim 4, wherein said sliding fitting includes a fixing member for fixing a position of said sliding fitting relative to the grip member.

* * * * *